United States Patent [19]

Haarstick et al.

[11] 3,974,791

[45] Aug. 17, 1976

[54] SAILS AND METHOD OF MANUFACTURE

[75] Inventors: Stephen H. Haarstick, Ithaca, N.Y.; John W. Lynch, Annapolis, Md.

[73] Assignee: Haarstick Sailmakers Chesapeake, Inc., Annapolis, Md.

[22] Filed: May 6, 1975

[21] Appl. No.: 574,931

[52] U.S. Cl. ..... 114/103

[51] Int. Cl.[2] ..... B63H 9/06

[58] Field of Search ..... 114/102, 103; 83/925 CC; 156/73.4, 157, 290

[56] References Cited

UNITED STATES PATENTS

| | | | |
|---|---|---|---|
| 3,118,801 | 1/1964 | Lamport | 114/103 |
| 3,445,307 | 5/1969 | Balamuth et al. | 156/73.4 |
| 3,459,149 | 8/1969 | Hallmark | 114/103 |
| 3,803,960 | 4/1974 | Pearl et al. | 83/925 CC |

*Primary Examiner*—Trygve M. Blix
*Assistant Examiner*—Sherman D. Basinger
*Attorney, Agent, or Firm*—Kemon, Palmer & Estabrook

[57] ABSTRACT

Sails for sailcraft, e.g., one-design racing sailboats, are made by forming a plurality of cloth panels by cutting all edges of each panel from a bolt of cloth according to predetermined rectangular coordinates, creating marks on the panels defining fair luff, leech and foot curves, overlapping the resulting panels and securing them together. Preferably, double faced adhesive tape is used in securing the panels, the seam overlaps between panels are of constant width and the panels are tack-welded together. Sails for use with racing one-design sailcraft that cannot be altered in shape without detection can be produced.

13 Claims, 7 Drawing Figures

SAILS AND METHOD OF MANUFACTURE

BACKGROUND OF THE INVENTION

1. Field of the Invention

This invention relates to sails for sailcraft and methods for their fabrication. More particularly, it concerns (1) new sail fabrication methods that eliminate operations in prior known methods, e.g., retabling to produce fair curves of luff, leech and foot, and (2) new forms of sails made from synthetic fiber cloth that cannot be altered in shape without detection to provide true onedesign racing in racing class sailboats.

The fabrication of sails for sailcraft has been practiced for centuries and can truly be classed as an art, i.e., each separate sail has been a separate work of the art of a particular sail maker. Hence, complete identity between sails has not been needed nor achieved in practice. Historically, these facts were of little or no concern to the users of sails, e.g., ancient workboat masters were interested in the strength and durability of their sails, not their identity with sails of another boat. Although wind is still used to a limited extend as the power for work-boats, the vast majority of extant sailcraft are used for pleasure, i.e., cruising and racing. Racing sailcraft dominate the field in terms of numbers and money spent in purchase and maintenance.

Modern racing sailcraft can be divided into several general classes, e.g., one-design, development and handicap. One-design boats are ideally supposed to be identical with each other in all respects as required by their class rules, e.g., hull dimensions, permitted equipment, etc.. In some one-design (OD) classes, sails may vary provided they do not exceed certain maximum limits, while in other OD classes the sails of all boats are supposed to be identical. A few OD classes have gone to the extent of restricting sails to those produced by one or a few selected sailmakers in an effort to achieve identity.

In the development classes, e.g., 12-meter yachts of "Americas Cup" fame and the International 14 dinghies, boats are open to variations of hull shape, sail configuration, etc., provided they conform to a formula that limits variable parameters in an interrelated manner. Such boats are raced as equals of one another, i.e., the first to finish wins. Measurements of boats and sails by skilled measurers are required to determine if they qualify and changes are either prohibited thereafter or, in some cases, permitted with remeasurement.

In the handicap classes, the boats may be built to any design of hull and size of sail. A handicap rating is then assigned to each boat by an official measurer calculated on a complex formula. In a handicap race, time allowances are given each yacht based on its rating, i.e., the first to finish is often not the winner. Recently, a variation of handicap racing was developed, i.e., so-called flat racing, as with ¼ ton, ½ ton, ¾ ton and 1 ton yachts, where handicap boats vary their sails, rigging, etc., so as to equal or approach a maximum rating for that class. In flat racing, all boats race as equals and the first to finish wins.

Sailing vessels are broadly divided into two types, i.e., fore-and-aft rigged and square-rigged. The former type may be further divided into those carrying gaff-headed mainsails and those carrying jib-headed or Marconi rig mainsails. The present invention is particularly relevant to fore-and-aft rigged vessels carrying jib-headed mainsails. Principle types of such boats are cat, sloop, cutter, yawl and ketch.

The new methods and products of this invention are pertinent to sails from all classes of racing sailcraft, including ice-boats, wheeled land-boats, as well as watercraft. However, the new methods and products have particular significance to one-design sailcraft.

There are literally thousands of different OD sailboat classes. They come and go, or fade in and out, as new designs are developed, old ones are changed to up-date them, etc.. There are a select few recognized by the International Yacht Racing Union (IYRU) for international competition, e.g., the Star class which is one of the oldest of the extant classes and widely sailed throughout the world. Only IYRU recognized boats are sanctioned for racing in the World Olympics and the present six olympic classes are:

Finn — a 14 ft. single-handed, center-board cat boat.
470 — a 15 ft. two-man, center-board sloop.
Flying Dutchman — a 20 ft. two-man center-board sloop.
Tempest — a 22 ft. two-man, keel sloop.
Soling — a 26 ft. three-man, keel sloop.
Toronado — a two-man sloop-rigged catamaran.

The world population of such small OD boats is very much greater than the larger in-board auxiliary sail yachts which may be raced on the open ocean (so-called off-shore racing) as well as in protected waters to which the small OD classes are mostly restricted. The new methods and products described below are particularly pertinent to the small OD classes because of the need for mass production and cost savings to maintain expense of racing such boats to a minimum. However, they may also be used to advantage in connection with the larger off-shore type yachts.

2. Description of the Prior Art

A fore-and-aft rig sail, whether it be a mainsail or headsail, is designed to have draft, i.e., a bow or bulge in the leeward side when properly hoisted on the boat for which it is designed. This draft is obtained by creating a convex curve in the luff of the sail so that when the sail is hoisted on its mast, usually straight or at least less curved than the sail luff, the mast forces the cloth from its curvature back into the sail to produce the draft. By then bending the mast forward in the center portion, some of the draft can be removed and this is frequently done on OD boats when required to adjust for change in wind strength.

The leech of a sail may be cut in a straight line, but more often it is also cut on a convex curve to provide roach, an excess of cloth usually supported for proper shape by battens. Roach adds extra sail area and usually assists a mainsail to produce weather helm.

The luff and leech curves in a sail are created by edge shapes of the panels forming the sail. The shaped panels are fixed together by seams produced by broad-seaming or seam tapering. The former produces a seam that varies in width along its length and is generally used in making one-off, large sails. The latter produces seams of substantially constant width. Regardless of the seam type used, the sail is formed of a plurality of panels cut from a bolt of cloth finished with straight parallel side edges formed by cutting off the selvage of the woven fabric. Up to the present, the edge of the cloth from the bolt has been used as one of the edges of the panels. Hence, in a four sided panel, only three edges would be severed to cut the panel from the bolt. If there is distortion in the edge of cloth when taken from the bolt, the final cut panels do not conform precisely to pattern. When a multiplicity of the same panels is cut from a pile of cloth sections for mass production of sails, dimension anomalies are increased. Consequently, sails have not previously been produced with the required luff and leech curves simply by cutting and seaming panels according to pattern. Thus, when the resulting cloth triangle is laid on a flat surface, the luff offsets are not then fair. Hence, a stick or other edging device is faired along marks in the luff, and a new luff is cut. The leech and foot are similarly faired in the operation known as retabling. The sail is then completed by putting on tapes, patches, luff rope, etc. There has been a need to improve on such known methods of making sails to eliminate the edge fairing after panel seaming and to eliminate dimension anomalies in the cutting of panels.

In most sail making, the joining together of the cloth panels involves simply seaming the panels on a sewing machine. However, it has been proposed to use adhesive to temporarily secure panels together to form a sail kit for subsequent stitching by the purchaser of the kit (see U.S. Pat. No. 3,459,149). Also, adhesive has been used in place of stitching to fix racing numerals on sails.

OBJECTS

A principle object of this invention is the provision of new methods of forming sails for sailcraft, particularly sails for one-design sailboats.

A further object is the provision of a new form of sails for racing sailboats that cannot be altered in shape without detection thereby ensuring that all boats racing in a one-design class race will have identical sails so that the difference in boat speed will be due to the skill of the helmsman, not to the sails.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The foregoing objects are, in part, accomplished according to this invention by a method for fabricating sails having a luff and leech from a plurality of cloth panels without need to retable for fairing luff, leech and foot which comprises the following combination of steps:

A. forming a plurality of cloth panels that collectively will form said sail from a bolt of cloth by cutting all edges of each panel according to predetermined rectangular coordinates, B. creating marks on the panels defining fair curves for said luff, leech and foot, C. assembling the resulting cut panels by overlapping a seam edge of a panel with the mating seam edge of another panel, and D. securing together the overlapped cloth panels.

Advantageously, the panel marks of Step B are formed by drilling holes through the cloth panels and Step D comprises the use of double-face adhesive tape as an interlayer between the overlaps of the panels. The panels after being secured together by such tape may be tack-welded along the seam overlap. The panels may be further secured together by thread stitching of the seams.

The objects are also accomplished by providing new forms of sails for use with racing one-design sailcraft that cannot be altered in shape without detection having luff, leech and foot and formed of a plurality of woven polyester cloth panels characterized by:

a. constant width seam overlaps between adjacent panels, b. a strip of double-face adhesive tape sandwiched between overlapped seam edges of adjacent panels, the seam overlaps being substantially constant in width equal to the width of said adhesive tape, and c. a plurality of separated aligned weldments between overlapped seam edges of adjacent panels.

The objects of the invention are also accomplished in accordance with the invention by provision of an assembly of cloth panels that is a partially formed sail which may be supplied to a sail finisher together with patches, tapes and similar items for machine stitching into a final, complete sail. Such an assembly comprises a plurality of woven synthetic fiber cloth panels fixed together at overlapped edges presenting a configuration representative of the desired completed sail, said assembly being characterized by:

A. constant width seam overlaps between adjacent panels and

B. small holes through each panel in the assembly marking fair curves for the luff, leech and foot of the sail to be formed from the assembly by stitching rolled edges on the assembly as defined by said holes.

BRIEF DESCRIPTION OF THE DRAWINGS

A more complete understanding of the invention may be had by reference to the accompanying drawings in which.

DESCRIPTION OF PREFERRED EMBODIMENTS

Figure 1:
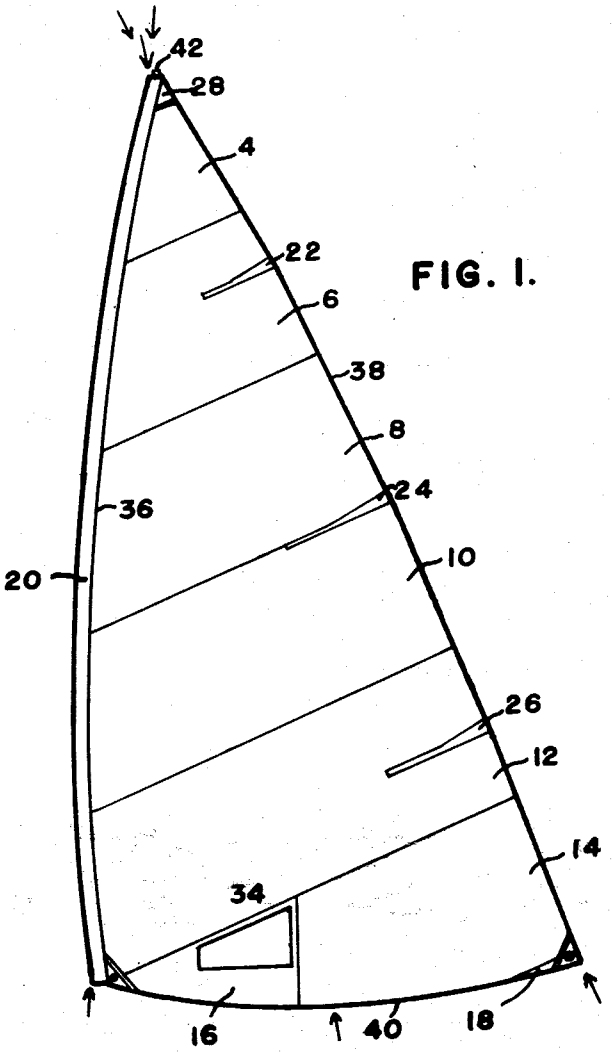
FIG. 1 is a plan view of a mainsail in accordance with the invention.

Referring in detail to the drawings, FIG. 1 shows the sail for a Lazer sailboat, a one-design centerboard cat-rig racing dinghy sanctioned as an international class by IYRU. The sail 2 is formed of seven cloth panels 4, 6, 8, 10, 12, 14 and 16; a small cloth wedge 18, mast tube 20, batten pockets 22, 24 and 26, head patch 28, tack patch 30, clew patch 32 and window 34. Sail 2 is a loosefooted sail and comprises luff 36, leech 38 and foot 40. The maximum dimensions for the Lazer sail in millimeters are:

| | |
|---|---|
| Luff | 5130 |
| Leech | 5570 |
| Foot | 2740 |

-continued

| | |
|---|---|
| ¼ leech width | 2340 |
| ½ leech width | 1730 |
| ¾ leech width | 975 |
| ½ foot height | 5380 |

Arrows on FIG. 1 indicate the lines of measurement for luff, leech and ½ foot height. The upper batten pocket 22 has a maximum length of 450 mm and the lower two 24 and 26 have maximum lengths of 640 mm. The size of the window 34 is 495 mm at the base, 185 mm at the front and 385 mm at the rear.

The Lazer has a free-standing mast of tubular aluminum which slips into the mast tube 20, i.e., the sail is not raised by a halyard in the manner of most sails. This arrangement reduces parts and weight and permits the mast to bend when the sail is sheeted hard as the boat beats to windward thereby allowing draft to be reduced in the sail for sail control in strong winds. A transverse strap 42 is fixed by stitching across the upper end of mast tube 20 to hold the sail at its head to the top of the mast (not shown).

There is a tack grommet 44 in the tack patch 30 for use in downhauling and a grommet 46 in the clew patch 32 for use in outhauling the sail.

Figure 2:
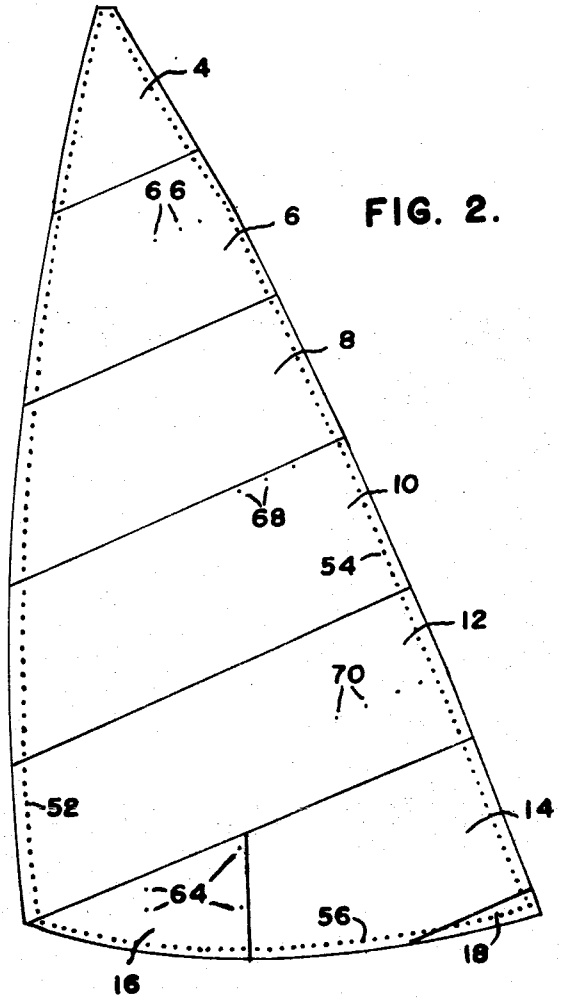
FIG. 2 is a plan view of a cloth panel assembly in accordance with the invention from which a completed sail can be made.

The sail of FIG. 1 is formed from an assembly 50 of cloth panels, as shown in FIG. 2, by stitching mast tube, patches, batten pockets and plastic window onto the assembly 50 and rolling and stitching the edges of the assembly along luff marks 52, leech marks 54 and foot marks 56 which are a series of holes that define the fair curves for the luff, leech and foot of the sail. Thus, with a preform assembly 50 produced in accordance with the invention as described hereinafter, any sailmaker can produce a finished sail without need to preform the prior required retabling operation to obtain fair luff, leech and foot.

A sail preform assembly as illustrated in FIG. 2 precisely fixes the final size and shape of the sail finished therefrom, thereby permitting truly uniform OD sails to be made on a mass production basis and at a minimum cost. Thus, preform assemblies 50 produced in a single plant using automated cutting equipment, as described below, can be sent to sailmakers throughout the world in a package with precut mast tube panel, patches batten pockets, plastic window, and grommets. These can then be stitched into the final sail by the foreign sailmaker usually with a saving in transportation expenses, as well as tariff and labor costs.

The manufacture of sails according to the invention begins with the formation of a plurality of cloth panels that collectively will form the sail from a bolt of cloth. In contrast to prior methods wherepanels are Where panels from the cloth so that one side thereof is the edge of the cloth bolt, i.e., cutting of one less than the total edges, all edges of each panel are cut from the cloth bolt. Further, this is done by moving the cutting tool according to predetermined rectangular coordinates rather than by cutting along a pattern. It has been discovered that by cutting sail panels in this manner dimension anomalies due to cloth stretch and triangulation are so mitigated that panels can be consistently cut so that no dimension varies more than about a mil from the required dimension. Moreover, such accuracy can be attained in accordance with the invention whether a single layer of cloth is cut, as would be the case for a one-off sail, or a pile of cloth sections is cut as in the case of mass production of OD sails.

Historically sails were made of cotton fabric, but this has been almost totally replaced by synthetic fiber fabrics because of rotting and stretch problems associated with cotton. Fabric formed of polyester fibers, e.g., polyethylene terephalate, is most widely used in present day sail production, although fabrics made of other synthetic fibers are also used, e.g., nylon and arylpolyamides. Fabric made specifically for sail production is generally treated to impart dimensional stability and is trimmed by removing the selvage to present an accurate width having clean-cut edges. Any available fabrics designed for sail making can be used in accordance with this invention.

To begin the cutting of cloth panels using predetermined rectangular coordinates, a portion of cloth is cut from a bolt and placed upon a substantially horizontal, flat, air-permeable surface. Apparatus for fabric cutting comprising such surface is disclosed in U.S. Pat. Nos. 3,548,697 and 3,677,123 (the disclosure of these patents and others referred to hereinafter are incorporated herein by reference). The cloth portion is then covered with non-fibrous, air-impermeable plastic film as disclosed in U.S. Pat. No. 3,598,006 and a vacuum is applied through said air-permeable support surface to the cloth portion, or typically a pile of cloth portions, and the covering plastic film. Advantageously, the vacuum is localized in a zone where a cutting head is operating upon the cloth as disclosed in U.S. Pat. No. 3,765,289.

With the cloth portion positioned as above described, panels are cut therefrom by a cutting tool driven according to predetermined X and Y coordinates such as disclosed in U.S. Pat. No. 3,495,492. Simultaneously, marks defining fair curves for the luff, leech, foot and other items, e.g., batten position, window position, etc., are applied. This can be by a marking pen or the like, but preferrably is done by drilling small holes in the fabric using apparatus such as disclosed in U.S. Pat. No. 3,730,634. Advantageously, the cutting and drilling tools are controlled by computer control means such as disclosed in U.S. Pat. No. 3,293,651. The computer may be programmed for the required rectangular coordinate cutting and marking according to known techniques although the methods and systems disclosed in U.S. Pat. No. 3,805,650 may be used in doing this.

Figure 3:
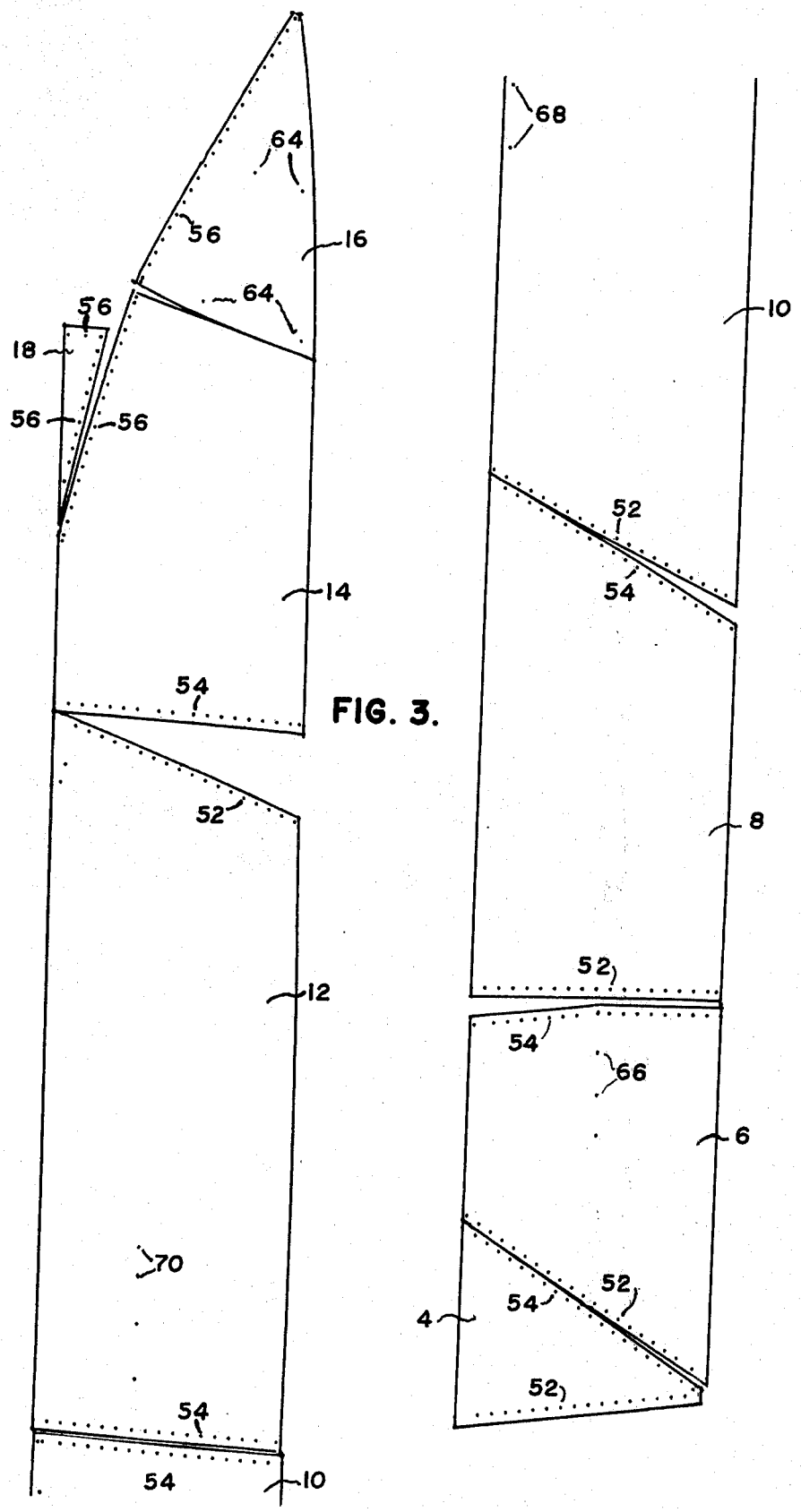
FIG. 3 is a plan view of a group of panels for a sail cut from a bolt of cloth in accordance with the invention.

Upon completion of the cutting and marking steps as described, the plastic film covering the cut cloth panels is removed and discarded. Also, those excess parts of the cloth which are not to be used in forming the sails can also be removed from the support surface and discarded. The remaining array of cloth panels which would be obtained for production of a Lazer sail is shown in FIG. 3 (the view is broken into two parts to permit the total array of panels to be shown on one sheet). The array comprises sail panels, 16, 14, 12, 10, 8, 6, 4 and 18. In panel 16, the marks 64 define the corners for the window 34. In panel 6, the marks 66 define the lower edge of batten pocket 22. In panel 10, the marks 68 define the lower edge of batten pocket 24 and in panel 12, the marks 70 define the lower edge of batten pocket 26. Marks 52, 54 and 56 on the panels define fair curves for the sail luff, leech and foot respectively.

Figure 5:
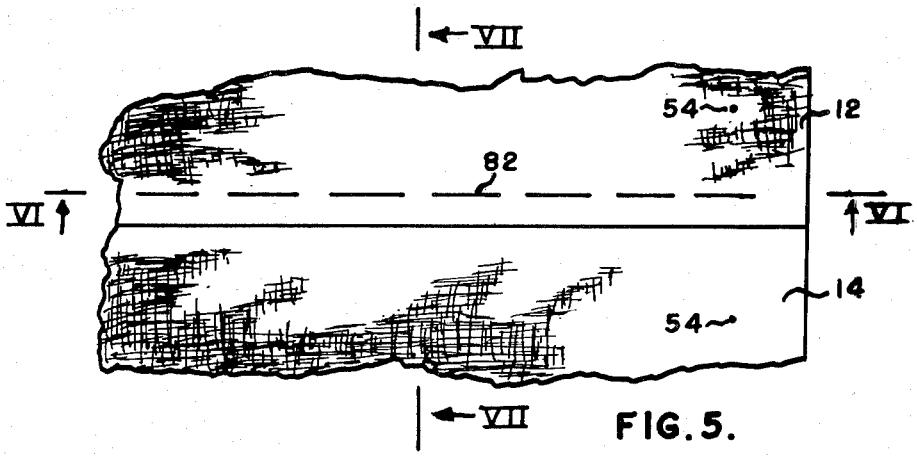
FIG. 5 is a fragmentary enlarged plan view of a portion of a seam of a sail panel assembly of the invention.
Figure 6:
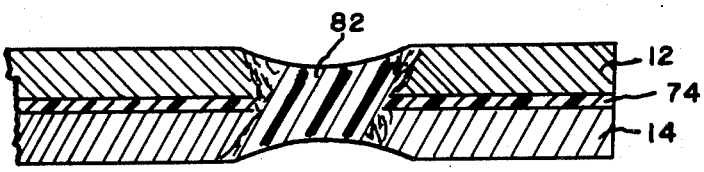
FIG. 6 is an enlarged, fragmentary sectional view taken on the line VI—VI of FIG. 4.

Panels from the array as shown in FIG. 3 are next formed into a connected assembly as illustrated in FIG. 2. This is accomplished using double face adhesive tape and a procedure to be described with reference to FIGS. 4–6.

Figure 4:
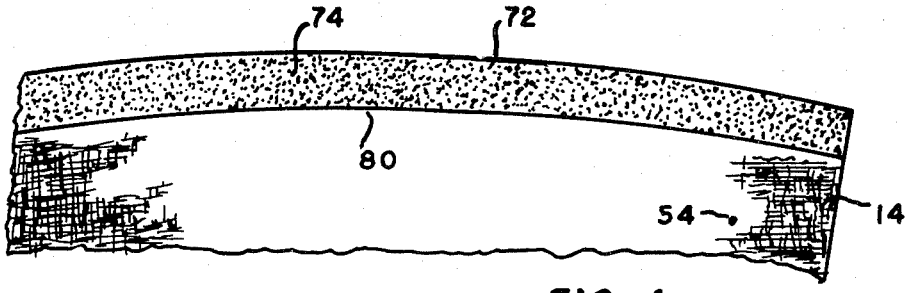
FIG. 4 is a fragmentary enlarged plan view of a portion of a cloth panel with double-faced adhesive tape attached thereto in accordance with the invention.

As explained previously, in order to obtain draft in the sail, curvature is built into the panel seams. This can be done by cutting curvature into one or both seam edges of the panels. In the case of the Lazer sails as above described, the curvature is cut on the top seam edge of panels leaving the bottom edges straight. This is not apparent in FIG. 3 because the scale is too small for the curvature to show. Also, since the draft varies from nil at the top to maximum slightly above the foot, the seam curvature is increased from panels 8 to 14. FIG. 4 shows the top and leech edges of panel 14 with the seam curvature exaggerated for the purpose of illustration.

Figure 7:
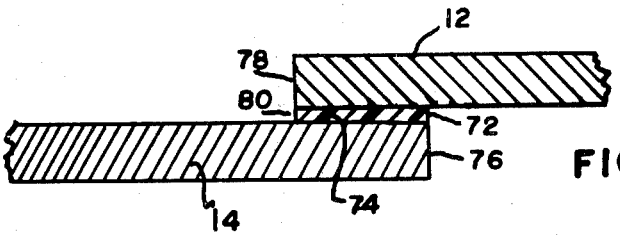
FIG. 7 is an enlarged, fragmentary sectional view taken on the line VII—VII of FIG. 4.

In forming the panel assembly of FIG. 2, double face adhesive tape having a release sheet on one side, e.g., tape "463" made by 3M Co., of suitable width, e.g., 15 mm., is applied to the top edge of each of panels 6, 8, 10, 12, 14 and 16 so that the outer edge 72 of the pressure sensitive adhesive tape 74 is flush with the top edge of the panel (in FIGS. 4 and 7, the top edge 76 of panel 14). A batch of separate panels may be taped in this manner and then stored for subsequent assembly. In any event, when the various panels to form the sail are assembled, the release sheet covering the top of the double-face adhesive tape (not shown) is removed exposing a fresh adhesive surface. To this, then, is applied the bottom edge of the adjacent panel, aligning the bottom edge of the panel, e.g., edge 78 of panel 12 in FIG. 7, with the inside edge 80 of the adhesive tape 74 thus producing a constant width seam.

If desired, the resulting panel assembly can be transformed directly into a finished sail. However, according to a preferred embodiment of the invention, the seam overlapped cloth panels are tack-welded together in addition to their adhesive union. A single continuous weld can be used along the seam overlap, but preferably a series of separated weldments 82 spaced at intervals along the seam are made. This is possible because of the thermoplastic property of the polyester, polyamide or equivalent synthetic fibers. The welding can be accomplished by any suitable means, e.g., electrically heated tool, R.F. welding blade, etc., but it has been found that an ultrasonic vibration tool, e.g., small vibrated disc, makes excellent weldments between the overlapped panels. There is produced in this manner an assembly of cloth panels for use in final production of racing sails as illustrated in FIG. 2. Such assemblies may be then finished on the spot into completed sails or shipped to foreign sailmakers for completion.

Completion of the sails will first involve seaming the sails along the panel seams, i.e., the adhesive union would not be strong enough to hold the panels together in extended use, particularly in strong winds. Next, the clew, head and tack patches are positioned and sewn in place. This is followed by folding the leech and foot along the fair curves defined by the marks 54 and 56 respectively. Then, the luff sleeve or tube 20 is sewn on along the luff curve defined by the marks 52. (In the case of most other sails than the Lazer, a luff tape or rope would be applied rather than a sleeve.) The usual hand-work of sewing on batten pockets, applying tack and clew grommets, etc., will complete the operation. The order of these finishing operations may be varied at the option of the sailmaker, e.g., batten pockets may be sewn on before finishing of the leech, etc. In any event, the result will be a completed OD racing sail of critical measurements precisely matching those of the same class sail even though finished by a different sailmaker who uses one of the mass produced panel assemblies of the invention. Attempts by a user of the sails to change draft or other shape of the sails by reseaming will be mitigated by the seam weldments, but even if accomplished such alteration will be detectable by an official class measurer and result in disqualification of the sail. The invention, therefore, provides significant improvements in sails for racing sailcraft and their methods of production.

We claim:

1. A method of fabricating a sail having a luff, leech and foot formed of a plurality of cloth panels without retabling for fairing of the luff, leech and foot which comprises:

A. forming a plurality of cloth panels that collectively will form said sail from a bolt of cloth by cutting all edges of each panel according to predetermined rectangular coordinates, B. creating marks on the panels defining fair curves for said luff, leech and foot, C. assembling the resulting cut panels by overlapping a seam edge of a panel with the mating seam edge of another panel, and D. securing together the overlapped cloth panels.

2. The method of claim 1 wherein said marks are formed by drilling holes through said cloth panels.

3. The method of claim 1 wherein said Step D comprises sandwiching double-faced pressure-sensitive adhesive tape between the overlapped cloth panels and then tack-welding of cloth panels along the seam overlap.

4. The method of claim 3 wherein said sail is for use with a one-design sailcraft and said cloth panels are formed in Step A to provide constant width seams in the overlapped panels of the sail corresponding to the width of said adhesive tape.

5. The method of claim 1 wherein said Step A comprises:

a. placing a portion of said bolt of cloth upon a substantially horizontal, flat, air-permeable surface, b. covering said cloth portion with non-fibrous plastic film, c. applying a vacuum through said airpermeable surface to the assembly of cloth portion and covering plastic film, and d. cutting said panels from said cloth portion by cutting means that penetrates said plastic film.

6. A method of fabricating a sail having a luff, leech and foot formed of a plurality of cloth panels without retabling for fairing of the luff, leech and foot which comprises:

A. forming a plurality of cloth panels that collectively will form said sail from a bolt of polyester cloth by cutting all edges of each panel according to predetermined rectangular coordinates, a plurality of said panels having four edges, two of which constitutes seam edges of the panel and are longer than the remaining two edges, B. drilling holes in the panels defining fair curves for said luff, leech and foot, C. applying double-face adhesive tape along one seam edge of each of the four-edge cut panels leaving the second seam edge thereof free, D. adhering said second seam edge of each panel to the mating adhesive tape bearing seam edge of an adjacent panel thereby creating an assembly of panels having constant seam overlaps corresponding in width to the width of said adhesive tape, and E. tack-welding together adjacent panels in said assembly along the seam overlaps thereof.

7. The method of claim 6 wherein said tackwelding is performed by frictional engagement of the seam overlap with an ultrasonic vibration tool at spaced intervals along the seam overlap.

8. An assembly of cloth panels produced by the method of claim 7.

9. A sail for use with a racing onedesign sailcraft that cannot be altered in shape without detection having luff, leech and foot and formed of a plurality of woven synthetic fiber cloth panels characterized by:

a. constant width seam overlaps between adjacent panels, b. a strip of double-face adhesive tape sandwiched between overlapped seam edges of adjacent panels, the seam overlaps being substantially constant in width equal to the width of said adhesive tape, and c. a plurality of separated aligned weldments between overlapped seam edges of adjacent panels.

10. A sail according to claim 9 wherein said panels are secured together by thread stitching in addition to said adhesive tape and weldments.

11. An assembly of cloth panels for use in production of a racing one-design sailcraft sail comprising a plurality of woven synthetic fiber cloth panels fixed together at overlapped edges presenting a configuration representative of the desired completed sail, said assembly being characterized by:

A. constant width seam overlaps between adjacent panels and

B. small holes through each panel in the assembly marking fair curves for the luff, leech and foot of the sail to be formed from the assembly by stitching rolled edges on the assembly as defined by said holes.

12. An assembly of claim 11 further characterized by:

a. a strip of double-face adhesive tape sandwiched between overlapped seam edges of adjacent panels and b. a plurality of separated aligned weldments between overlapped seam edges of adjacent panels in each panel-joining seam of the assembly.

13. The assembly of claim 12 wherein said cloth panels are formed of polyester fibers.

* * * * *